US010500475B2

(12) United States Patent
Walsh

(10) Patent No.: US 10,500,475 B2
(45) Date of Patent: Dec. 10, 2019

(54) SPACER FOR SNOWBOARD

(71) Applicant: Daniel Joseph Walsh, South Lake Tahoe, CA (US)

(72) Inventor: Daniel Joseph Walsh, South Lake Tahoe, CA (US)

(73) Assignee: Daniel Joseph Walsh, South Lake Tahoe, CA (US)

( * ) Notice: Subject to any disclaimer, the term of this patent is extended or adjusted under 35 U.S.C. 154(b) by 0 days.

(21) Appl. No.: 16/032,513

(22) Filed: Jul. 11, 2018

(65) Prior Publication Data

US 2019/0160364 A1 May 30, 2019

Related U.S. Application Data

(60) Provisional application No. 62/591,628, filed on Nov. 28, 2017.

(51) Int. Cl.
*A63C 10/14* (2012.01)
*A63C 10/16* (2012.01)

(52) U.S. Cl.
CPC ..... *A63C 10/16* (2013.01); *A63C 10/14* (2013.01)

(58) Field of Classification Search
CPC ..... A63C 9/005; A63C 10/14; A63C 10/16
See application file for complete search history.

(56) References Cited

U.S. PATENT DOCUMENTS

| | | | | |
|---|---|---|---|---|
| 5,895,068 | A * | 4/1999 | Doyle | A63C 10/08 280/14.21 |
| 6,505,841 | B1 * | 1/2003 | Kessler | A63C 10/14 280/14.21 |
| 7,766,363 | B2 * | 8/2010 | Farcot | A63C 10/20 280/14.21 |
| 8,276,921 | B2 * | 10/2012 | Walker | A63C 9/0802 280/14.24 |
| 9,364,738 | B2 * | 6/2016 | Kim | A63C 10/14 |
| 2004/0145155 | A1 * | 7/2004 | Martin | A63C 10/14 280/618 |
| 2004/0201202 | A1 * | 10/2004 | Sato | A63C 10/14 280/617 |
| 2005/0253347 | A1 * | 11/2005 | Martin | A63C 10/14 280/14.22 |
| 2006/0119054 | A1 * | 6/2006 | Kunz | A63C 10/14 280/14.22 |

* cited by examiner

*Primary Examiner* — Bryan A Evans
(74) *Attorney, Agent, or Firm* — Perkins Coie LLP

(57) ABSTRACT

The disclosure is directed to a spacer block for elevating a boot of a rider of a snowboard. Due to the elevation of the boot above the snowboard, the boot drag of the rider is reduced. The spacer block is installed between the snowboard and a binding system of the snowboard that secures the rider's feet to the snowboard. By adding the spacer between the snowboard and the binding system, the boots are now elevated above the snowboard, and the rider can make sharper, more angled turns without the toes or heel of their boot contacting the snow. While the application describes the spacer block to be used with a snowboard, the spacer block can be used with boards for other recreational activities where boot drag is a problem. For example, the spacer block can be used with boards for gliding on sand, or with boards for rolling on ground.

19 Claims, 6 Drawing Sheets

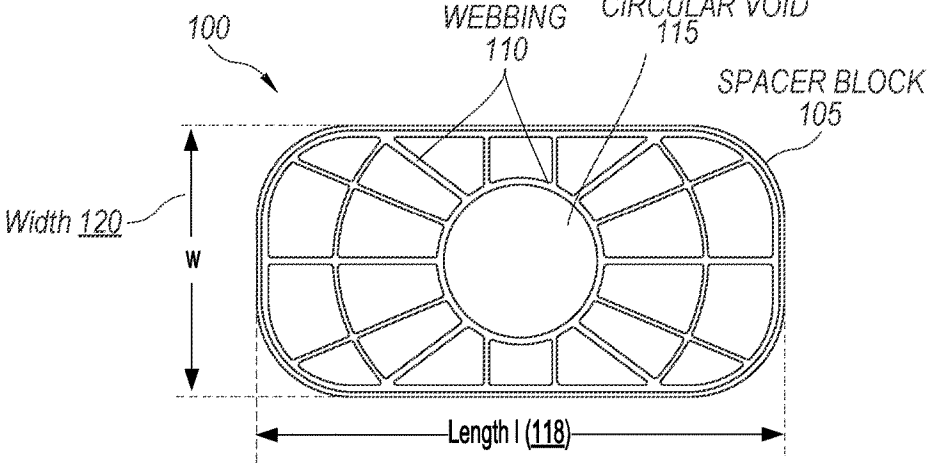
Fig. 1A
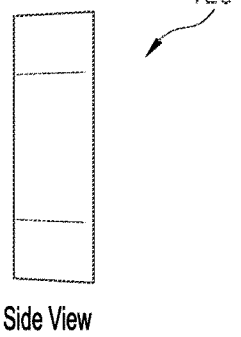
Fig. 1B
Fig. 1C
Side View
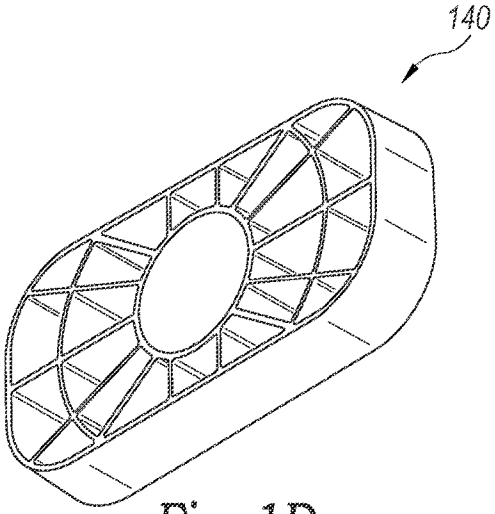
Fig. 1D

SPACER FOR SNOWBOARD

CROSS-REFERENCE TO RELATED APPLICATION(S)

This application claims the benefit of U.S. Provisional Patent Application Ser. No. 62/591,628, entitled "SPACER FOR SNOWBOARD" filed on Nov. 28, 2017, which is incorporated by reference herein in its entirety.

TECHNICAL FIELD

This disclosure relates generally to action sports equipment. More particularly, the disclosure is related to Snowboarding.

BACKGROUND

If a snowboarder has big feet, their boots hang over the edge of their snowboard. "Boot drag" is a scenario where a rider's toes or heel are drag in the snow when the snowboard is tipped on edge. When a rider has boot drag, they may lose edge control and wipe out. The rider may choose to cram their feet into smaller sized boots or buy a snowboard that is wider than other contemporary models. One can use a spacer for solving the problem of boot drag. The spacer is installed between the binding and the upper surface of the snowboard. The spacer elevates the foot of the rider from the surface of the snowboard and thus, reduces the boot drag. However, typical risers are simple plastic disks that are either not long lasting, detach from the snowboard accidentally, which can result in accidents that cause injury to the rider. Further, the current spacers have limited compatibility with bindings. That is, a spacer may be compatible with a first binding but not with a second binding, which necessitates the rider to change the spacer when the binding is changed, which increases the cost for the rider.

SUMMARY

Introduced here is a spacer block for elevating a boot of a rider of a snowboard. Due to the elevation of the boot above the snowboard, the rider may be able to reduce boot drag. The spacer block is installed between the snowboard and a binding system of the snowboard, which is used to secure the rider's feet to the snowboard. By adding the spacer between the snowboard and the binding system, the boots are now elevated above the snowboard, and the rider can make sharper, more angled turns without the toes or heel of their boot contacting the snow. While the application describes the spacer block to be used with a snowboard, the spacer block can be used with boards for other recreational activities where boot drag is a problem. For example, the spacer block can be used with boards for gliding on sand, or with boards for rolling on ground.

The spacer block is of a specified thickness, which is indicative of a height by which the boot of the rider is to be elevated above the snowboard. The spacer block is made of lightweight and water-resistant material. The spacer block is compatible with multiple types of binding systems, which prevents the rider from having to change the spacer block when the user changes the snowboard or the binding system.

BRIEF DESCRIPTION OF THE DRAWINGS

One or more embodiments of the present disclosure are illustrated by way of example and not limitation in the figures of the accompanying drawings, in which like references indicate similar elements.

FIG. 1A is a block diagram of a spacer block.

FIG. 1B illustrates a first side view of the spacer block.

FIG. 1C illustrates a second side view of the spacer block.

FIG. 1D illustrates a perspective view of the spacer block.

DETAILED DESCRIPTION

Figure 2:
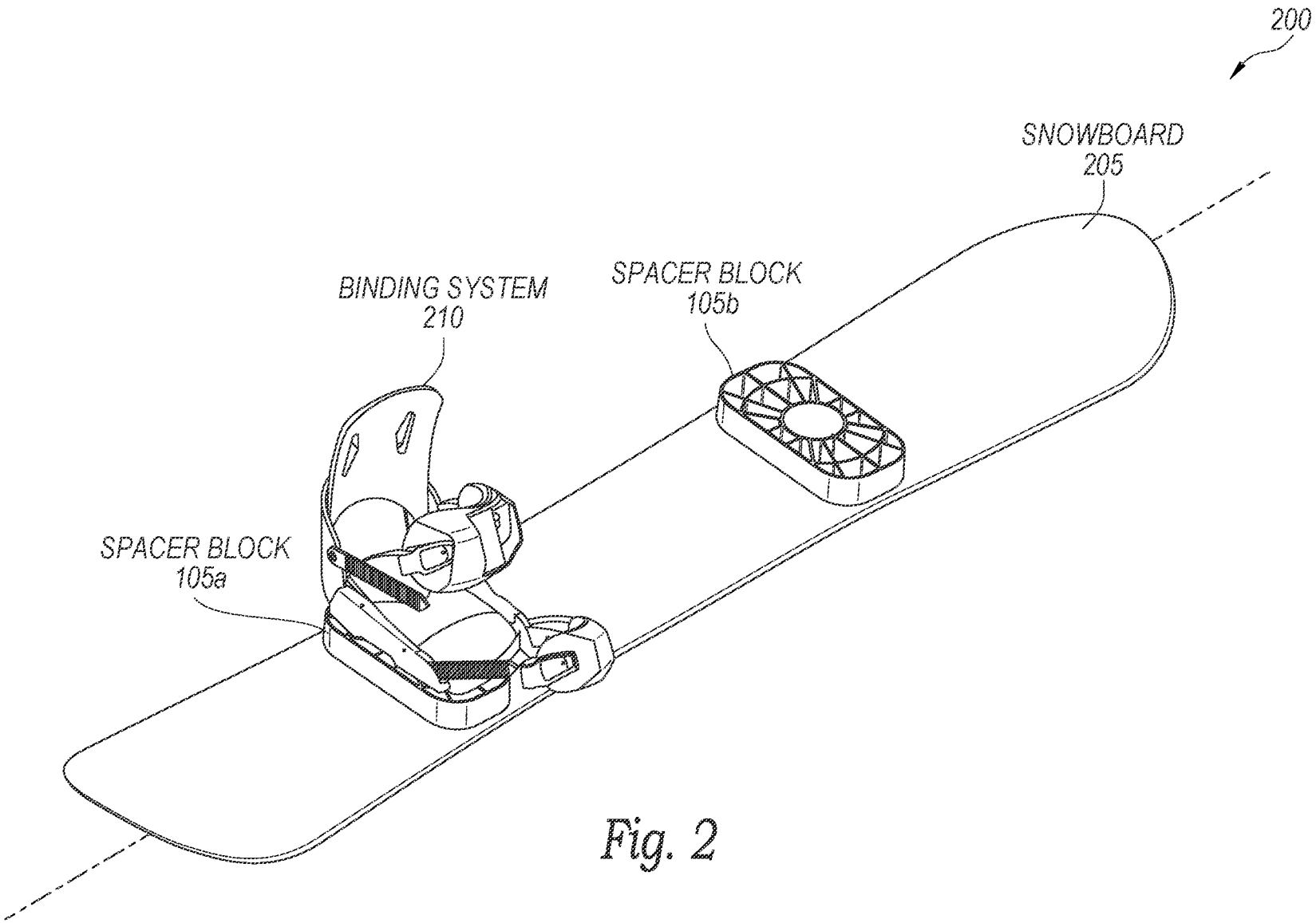
FIG. 2 is an example of a snowboard with a pair of spacer blocks.

FIG. 1, which is a collection of FIGS. 1A-1D, is a block diagram of a spacer block 105 for use with recreational boards. FIG. 1A illustrates a top view 100 of the spacer block 105. The spacer block 105 can be used with a recreational board, such as a snowboard, to elevate a boot of a rider from the recreational board to reduce the boot drag. The spacer block 105 is installed between the snowboard and a binding system of the snowboard, which is used to secure a boot of the rider to the snowboard. Two spacer blocks are installed on the snowboard to elevate both the boots of the rider.

The spacer block 105 can be of any size and shape that is suitable for installing on a snowboard. In some embodiments, the spacer block 105 is of a rectangular shape with rounded edges. The size of the spacer block 105 is represented in length (l) 118, width (w) 120 and thickness (t) 135. In some embodiments, the length 118 of the spacer block 105 is the greatest of the three dimensions, the thickness 135 is the least of the three dimensions, and the width 120 is between the length 118 and thickness 135. The thickness 135 is typically indicative of a height by which the boot of the rider is to be elevated above the snowboard. An example dimension in terms of l*w*t of the spacer block 105 can be 25 cm*12.5 cm*3.5 cm. In some embodiments, the length 118 of the spacer block 105 is less than the width of the snowboard.

The spacer block 105 includes a circular void, a circular opening, a circular hollow center, or a circular hole (referred to as "circular void 115") that facilitates mounting of the binding system on the snowboard with the spacer block 105. A binding system is mounted onto the snowboard using a fastener of one or more types, e.g., a machine screw. Different types of binding systems can use different types of fasteners and different number of fasteners for mounting. In some embodiments, to mount the binding system with the spacer block 105, one or more fasteners are inserted from the binding system through the circular void 115 and fixed to the snowboard (which is described in detail at least with reference to FIG. 5). The circular void 115 is large enough to allow one or more fasteners of different types of binding systems to be inserted through for mounting the binding systems onto the snowboard. In some embodiments, a diameter of the circular void 115 is 7.5 cm. However, the diameter can be of other dimensions, e.g., greater or lesser than the above, as long as it facilitates mounting of different types of binding systems. As can be appreciated, the circular void 115 enables the spacer block 105 to be compatible with multiple types of binding systems.

The spacer block 105 includes a support structure, such as a webbing 110, for supporting a boot of the rider. In some embodiments, the support structure is constructed around the circular void 115. The support structure supports the boot of the rider when the rider stands in the binding system mounted on the spacer block 105, and prevents the boot or the binding system from "sinking" into the spacer block 105. The webbing 110 is a mesh-like support structure. However, the support structure can be of a different design or pattern as long as it can support the boot. For example, the support structure can be a solid surface. In some embodiments, the support structure is designed such that a weight added to the spacer block 105 is minimized while providing adequate support to the boot, e.g., adequate enough to prevent the boot of a rider from sinking into the spacer block 105. In some embodiments, the walls of webbing 110 are around 6 mm-8 mm thick, e.g., in a lightweight spacer block, and around 3 mm-4 mm thick in ultra-lightweight spacer block.

The spacer block 105 can be made of a strong, sturdy but lightweight material, such as plastic or wood. The material should be strong and sturdy enough to withstand a weight of the rider without deforming the spacer block 105 and prevent the boot of a rider from sinking into the spacer block 105 while still being lightweight. In some embodiments, the material is considered to be lightweight when a spacer block, such as the spacer block 105, do not weigh more than a pound, and ultralightweight when the spacer block 105 does not weight more than half a pound. In some embodiments, the spacer block 105 is made of polypropylene. In some embodiments, the spacer block 105 is made of decking wood. In some embodiments, the spacer block 105 is made of a water-resistant material, or is coated with a water-resistant substance/material, which can help in increasing the life of the spacer block 105 in recreational activities where the recreational boards are exposed to water or used in wet conditions, such as in snowboarding.

FIG. 1B illustrates a first side view 125 of the spacer block 105. The first side view 125 shows the spacer block 105 along the width of the spacer block 105 with a side along the width being perpendicular to the ground.

FIG. 1C illustrates a second side view 130 of the spacer block 105. The second side view 130 shows the spacer block 105 along the length of the spacer block 105 with a side along the length being parallel to the ground.

FIG. 1D illustrates a perspective view 140 of the spacer block 105. In the perspective view 140, multiple dimensions, e.g., length 118, width 120 and thickness 135, of the spacer block 105 can be visualized.

FIG. 2 is an example 200 of a snowboard 205 with a pair of spacer blocks. In the example 200, a binding system 210 is mounted onto the snowboard 205 with the spacer block 105*a*. Another spacer block 105*b* is placed on the snowboard 205 for illustrative purposes (and is not mounted). In some embodiments, the spacer blocks 105*a* and 105*b* are similar to the spacer block 105 of FIG. 1. The spacer block 105*a* is placed on the appropriate portion of the snowboard 205, e.g., binding area, and then the binding system 210 is placed on top of the spacer block 105*a* and attached to the snowboard 205 using attaching means, e.g., one or more fasteners or other snap-in mechanisms. The same is repeated for the spacer block 105*b* with another binding system.

In some embodiments, if the snowboard 205 already has the binding system 210, then the binding system 210 is removed, and then installed with the spacer block 105*a* as described above.

Figure 3:
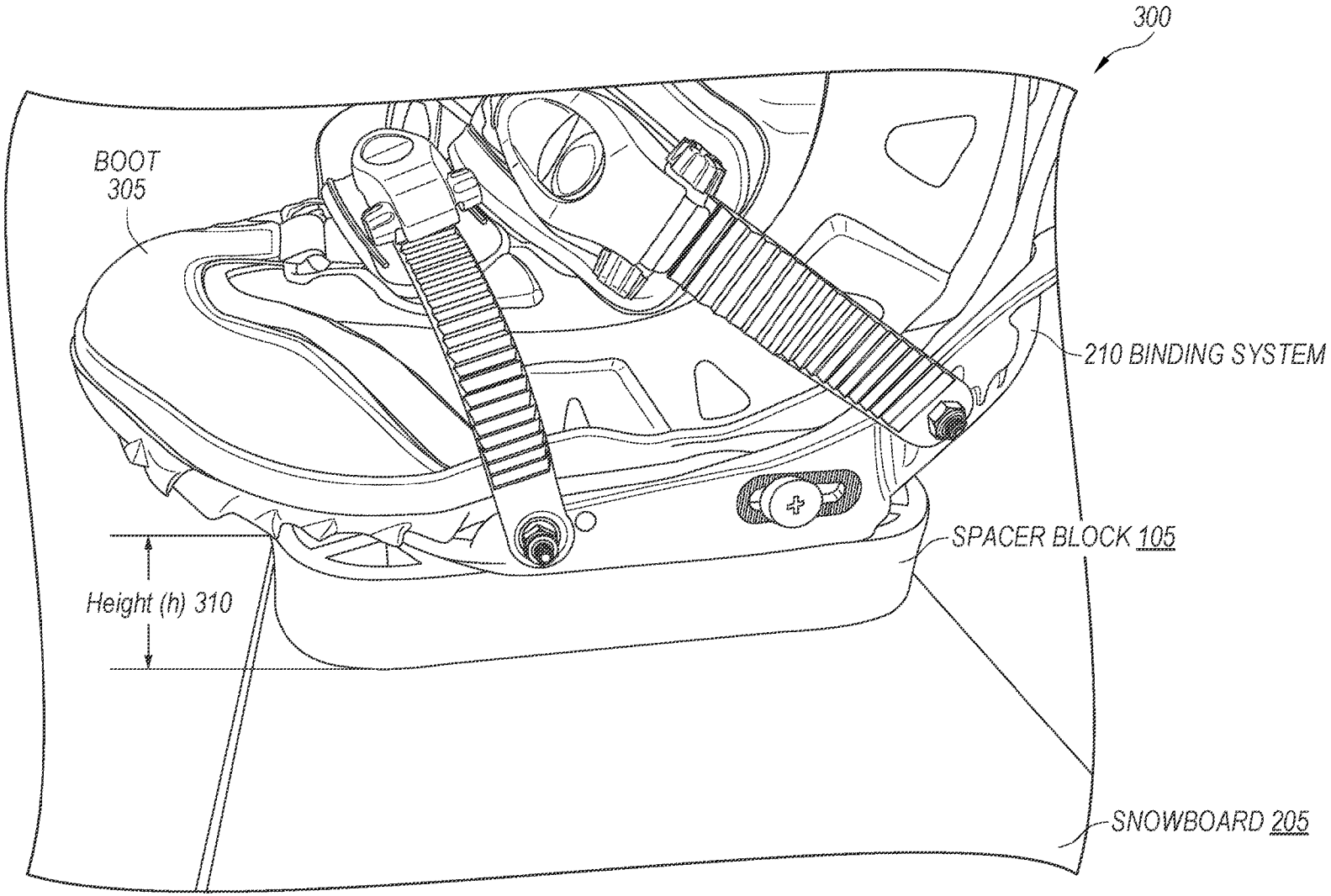
FIG. 3 is a close-up view of the spacer block installed on the snowboard with a binding system.

FIG. 3 is a close-up view 300 of the spacer block 105 installed on the snowboard 205 with the binding system 210. As can be seen in the close-up view 300, the spacer block 105 elevates for the boot 305 of the rider by a height (h) 310. This elevation can provide by the spacer block 105 can reduce a boot drag and therefore, provide more edge control to the rider. The rider can make more angled carves (e.g., angle the snowboard 205 into the snow) without boot drag. That is, the angle with which the rider can carve the snowboard 205 with the spacer block 105 is greater than the angle the rider can carve the snowboard 205 without the spacer block 105. For example, consider that for a rider with a boot size of U.S. 11 or above carving at an angle of greater than 15 degrees can cause a boot drag, that is, the toe of the boot 305 touches the ground (e.g., snow) when the rider carves the snowboard 205 at angle greater than 15 degrees. Continuing with the example, with the use of the spacer block 105, the boot 305 is elevated by a height 310, which enables the rider to carve at angles up to 60 degrees without boot drag.

The height 310 by which the boot 305 is elevated depends on the thickness 135 of the spacer block 105. Note that the above carving angles are just examples and the carving angles can vary based on at least one of the thickness of the spacer block 105, boot size of the rider, or width of the snowboard 205.

Figure 4A:
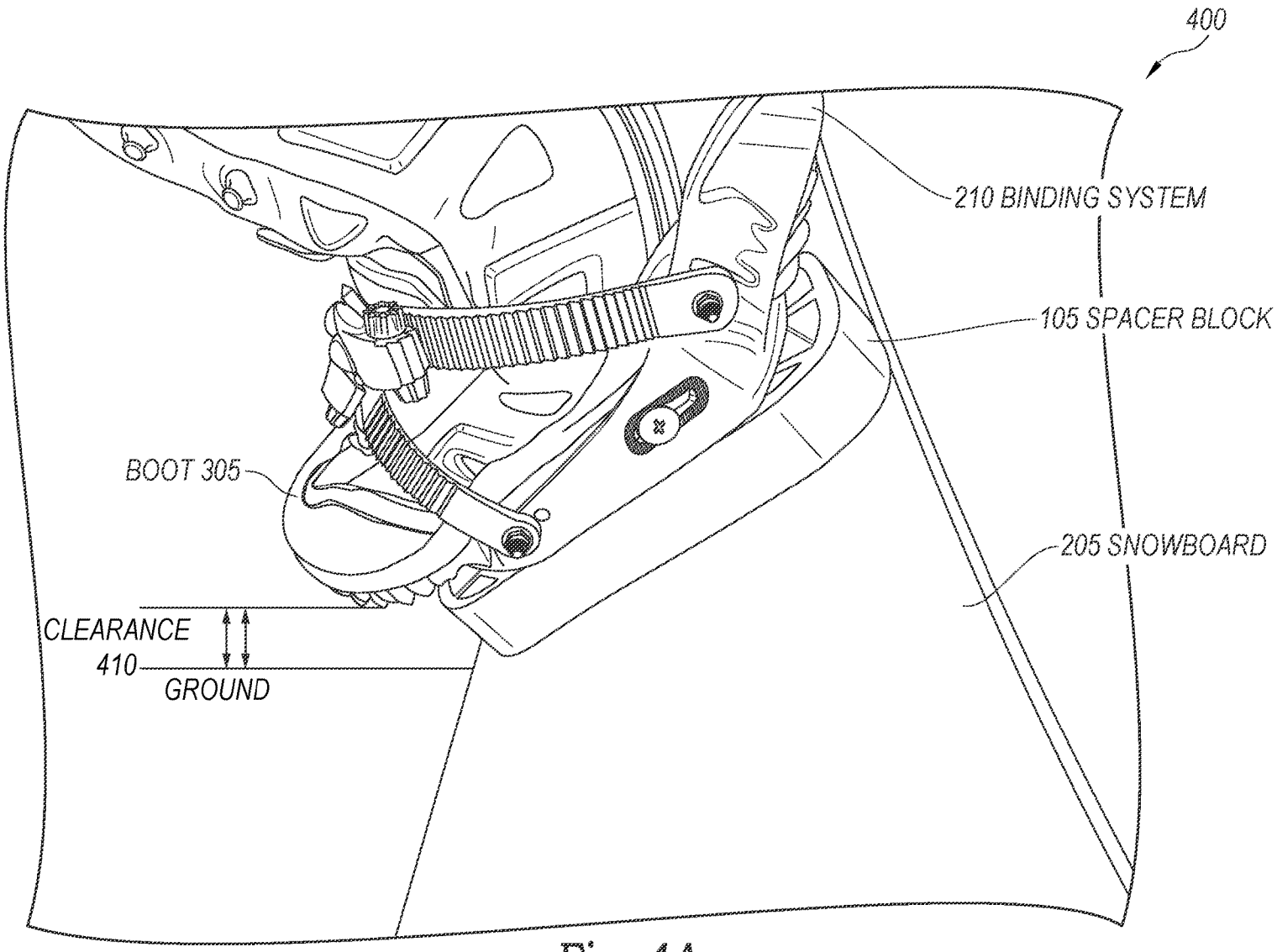
FIG. 4A is an example illustrating angle carving the snowboard with the spacer block.
Figure 4B:
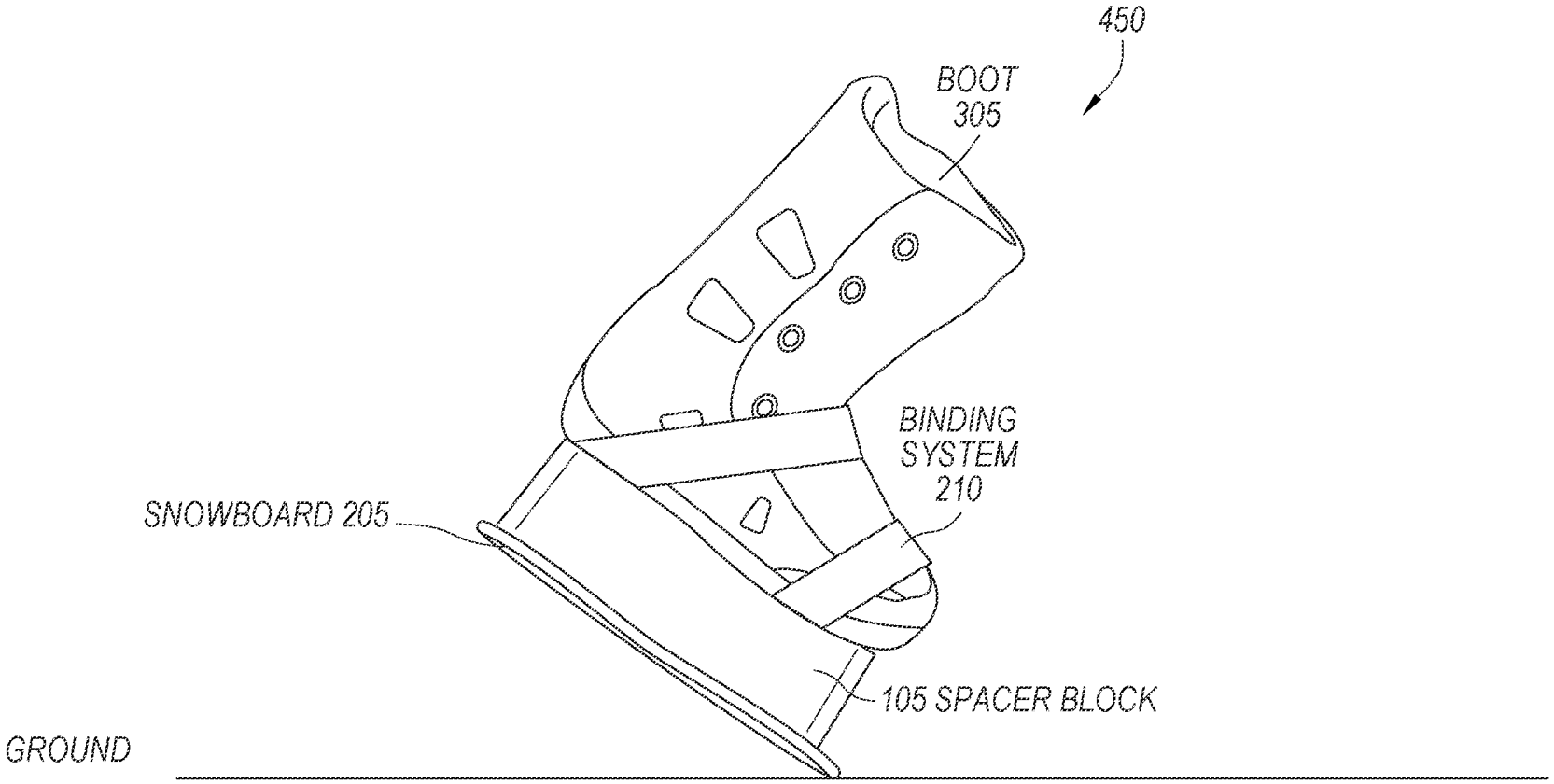
FIG. 4B is another example illustrating angle carving the snowboard with the spacer block.

FIGS. 4A and 4B are examples 400 and 450 illustrating angle carving the snowboard with the spacer block. The examples 400 and 450 illustrate the angle carving discussed in FIG. 3. The example 400 shows the snowboard 205 carved at an angle of approximately 35 degrees with no boot drag. That is, by adding the spacer block 105 to the snowboard 205, the rider with a specified boot size can carve the snowboard 205 at 35 degrees without any boot drag which may not have been possible without the spacer block 105 for the same specified boot size. The example 400 shows that the spacer block 105 provides a clearance 410 (e.g., anywhere between 0 and height 310) from the ground to the toe of the boot 305 even when the snowboard 205 is carved at an angle of 35 degrees. Without the spacer block 105, the boot 305 of the rider may be touching the ground when the snowboard 205 is carved at 35 degrees from the ground. In some embodiments, the spacer block 105 can enable the rider to carve at angles up to 60 degrees without any boot drag.

FIG. 4B is another example 450 illustrating angle carving the snowboard with the spacer block.

Figure 5:
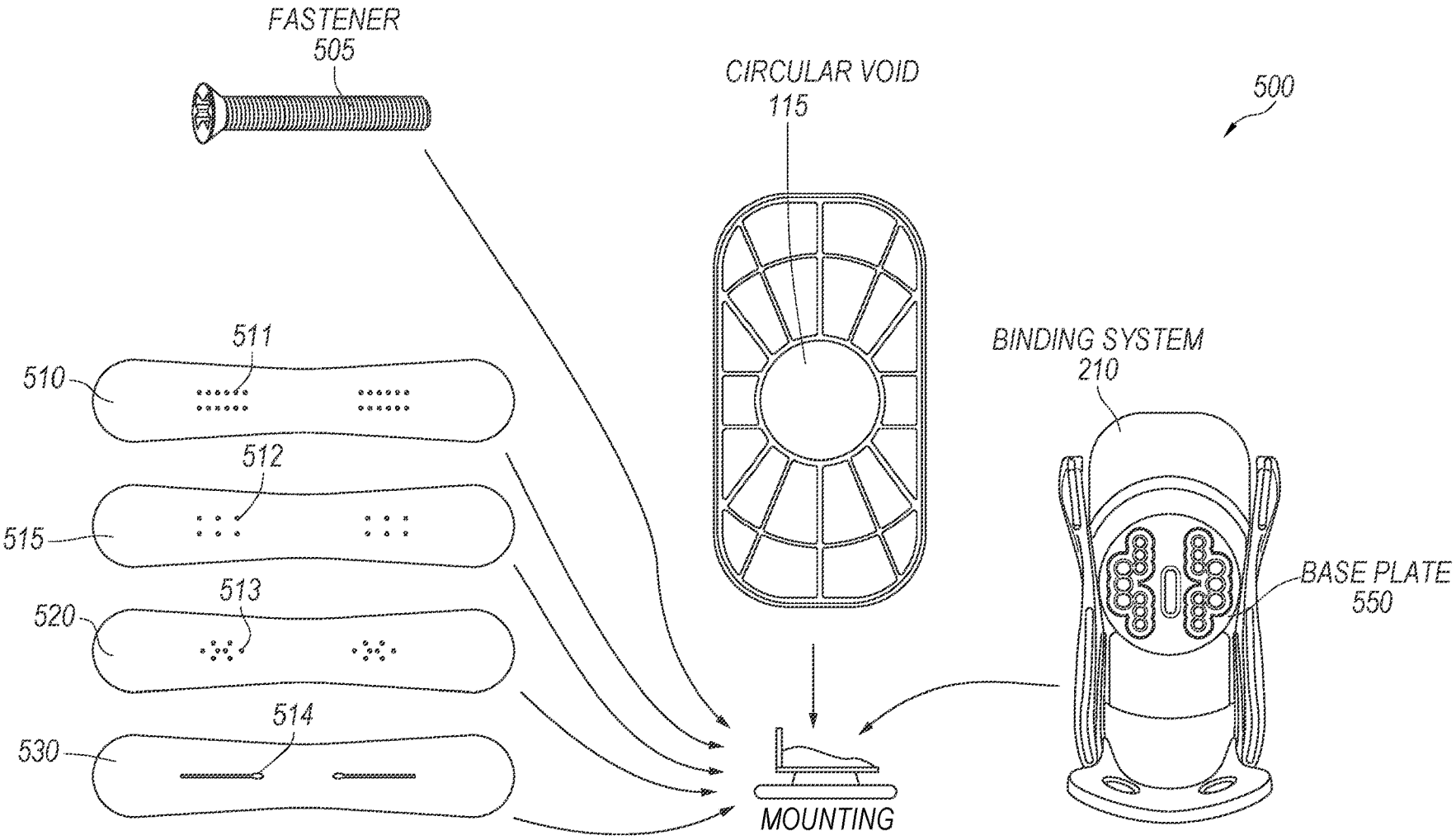
FIG. 5 is a block diagram of an example illustrating mounting of the binding system with the spacer block on the snowboard.

FIG. 5 is a block diagram of an example 500 illustrating mounting of the binding system with the spacer block 105 on a snowboard. The example 500 illustrates snowboards with different mounting patterns for a binding system. A first snowboard 510 has two binding areas of a first mounting pattern 511, such as 2*4 mounting pattern in which each binding area has two rows of mounting holes spaced 4 cm apart and holes in each row are spaced 2 cm apart. A second snowboard 515 has two binding areas of a second mounting pattern 512, such as 4*4 mounting pattern in which each binding area has two rows of mounting holes spaced 4 cm apart and holes in each row are spaced 4 cm apart. A third snowboard 520 has two binding areas of a third mounting pattern 513, such as a diamond shaped "3D" mounting pattern. A fourth snowboard 530 has two binding areas of a fourth mounting pattern 514, such as a channel. In some embodiments, the snowboards illustrated in the example 500 are similar to the snowboard 205 in FIG. 2.

The binding system 210 is mounted onto any of the snowboards, e.g., the first snowboard 510, using a mounting mechanism, e.g., a fastener 505 such as a 50 mm bolt. The binding system 210 includes a binding base plate 550, which forms a binding interface for binding the binding system 210 to the first snowboard 510 at the binding area. The binding base plate 550 feature holes that are compatible with one or more mounting patterns of the snowboards. In the example 500, the binding base plate 550 of the binding system 210 is compatible with all the four mounting patterns illustrated in the example 500. However, in some embodiments, the binding base plate 550 may be compatible with only one mounting pattern. In some embodiments, the binding base plate 550 is detachably attached to the binding system 210 so that the binding base plate 550 can be replaced with another base plate to make the binding system 210 compatible with a different type of mounting pattern. The binding system 210 is mounted onto the first snowboard 510 by placing the binding system 210 at the binding area and fastening it to the first snowboard 510 using one or more fasteners 505.

The spacer block 105 is installed between the binding system 210 and the first snowboard 510. In one example, the spacer block 105 is placed on the first snowboard 510 in the binding area such that at least a portion of the first mounting pattern 511 is accessible by one or more of the fasteners 505 through the circular void 115 of the spacer block 105. Then the binding system 210 is placed on the spacer block 105 such that the holes featured in the binding base plate 550 is within the circular void 115, and then the binding system 210 is attached to the first snowboard 510 using the one or more fasteners 505. The one or more fasteners 505 pass through the circular void 115 for attaching the binding system 210 to the first snowboard 510.

Different binding systems may require different number of fasteners for mounting onto the snowboard. A first type of binding system may require two fasteners, and a second type of binding system may require three or more fasteners 505. The spacer block 105 is designed such that it is compatible with many types of binding systems, e.g., the circular void 115 is large enough to accommodate different number of fasteners or different types of fasteners, such as at least two fasteners 505. While the spacer block 105 is described as having a circular void 115 that enables one or more of the fasteners to pass through, the void can be of other shapes and sizes, which allows the spacer block 105 to be compatible with multiple types of binding systems. For example, the void can be of any size and shape that allows for the fasteners of multiple types of binding systems to be inserted through the void for securing the binding systems to the snowboard.

Any or all of the features and functions described above can be combined with each other, except to the extent it may be otherwise stated above or to the extent that any such embodiments may be incompatible by virtue of their function or structure, as will be apparent to persons of ordinary skill in the art. Unless contrary to physical possibility, it is envisioned that (i) the methods/steps described herein may be performed in any sequence and/or in any combination, and that (ii) the components of respective embodiments may be combined in any manner.

Although the subject matter has been described in language specific to structural features and/or acts, it is to be understood that the subject matter defined in the appended claims is not necessarily limited to the specific features or acts described above. Rather, the specific features and acts described above are disclosed as examples of implementing the claims, and other equivalent features and acts are intended to be within the scope of the claims.

From the foregoing, it will be appreciated that specific embodiments of the invention have been described herein for purposes of illustration, but that various modifications may be made without deviating from the scope of the invention. Accordingly, the invention is not limited except as by the appended claims.

I claim:

1. An apparatus for providing an elevated installation of a binding system of a snowboard, comprising:

a spacer block that is configured to be installed on a snowboard, wherein the spacer block, when used with the binding system, is configured to elevate the binding system on the snowboard by a thickness of the spacer block, wherein the spacer block includes a circular void at the center of the spacer block to enable mounting of the binding system with the spacer block on the snowboard, and wherein the spacer block includes means for mounting the binding system to the spacer block.

2. The apparatus of claim 1, wherein the spacer block is configured to enable affixing of the binding system to the snowboard through the circular void.

3. The apparatus of claim 1, wherein the spacer block is configured to be installed between the binding system and the snowboard.

4. The apparatus of claim 1 further comprising:

one or more fasteners for mounting the binding system with the spacer block on the snowboard.

5. The apparatus of claim 4, wherein the spacer block is configured to be installed with the binding system to the snowboard using the one or more fasteners through the circular void.

6. The apparatus of claim 1, wherein the spacer block includes a webbing to support the binding system.

7. The apparatus of claim 6, wherein the webbing is around the circular void.

8. The apparatus of claim 1, wherein the spacer block is made of a water-resistant material.

9. The apparatus of claim 1, wherein the spacer block is made of plastic.

10. The apparatus of claim 1, wherein the spacer block is made of polypropylene.

11. The apparatus of claim 1, wherein the spacer block is made of water resistant wood.

12. The apparatus of claim 1, wherein the spacer block has dimensions of 25 cm by 12.5 cm by 3.5 cm as a length, width and thickness, respectively, and wherein the circular void is of a diameter 7.5 cm.

13. The apparatus of claim 1, wherein a depth of the circular void is equal to the thickness of the spacer block.

14. An apparatus, comprising:

one or more fasteners for mounting a binding system on a snowboard; and a spacer block of a specified thickness to elevate the mounting of the binding system on the snowboard by the specified thickness, wherein the spacer block includes a hollow opening at the center of the spacer block to receive the one or more fasteners for mounting the binding system on the snowboard, wherein the spacer block is configured to be installed between the binding system and the snowboard, and wherein the spacer block includes means for mounting the binding system to the spacer block.

15. The apparatus of claim 14, wherein the spacer block includes support structure around the hollow opening to support the binding system.

16. The apparatus of claim 15, wherein the support structure is a solid surface.

17. The apparatus of claim 15, wherein the support structure is a webbing.

18. An apparatus, comprising:

a snowboard;

a pair of binding systems to secure feet of a rider of the snowboard to the snowboard; and a pair of spacer blocks that is installed between the pair of binding systems and the snowboard, the pair of spacer blocks elevating the pair of binding systems above the snowboard by a specified height, wherein a spacer block of the pair of spacer blocks includes a hollow opening at the center of the spacer block through which a binding system of the pair of binding systems is affixed to the snowboard, and wherein the spacer block includes means for mounting the binding system to the spacer block.

19. The apparatus of claim 18, wherein the pair of spacer blocks is made of water-resistant material.

* * * * *